United States Patent [19]

Peterson et al.

[11] Patent Number: 4,865,116

[45] Date of Patent: Sep. 12, 1989

[54] CONTINUOUS METAL TUBE CASTING METHOD AND APPARATUS

[75] Inventors: Jeffrey N. Peterson, Roswell, Ga.; Robert T. Frost, Berwyn, Pa.

[73] Assignee: General Electric Company, New York, N.Y.

[21] Appl. No.: 212,110

[22] Filed: Jun. 28, 1988

Related U.S. Application Data

[63] Continuation of Ser. No. 901,616, Aug. 29, 1986, abandoned, which is a continuation-in-part of Ser. No. 627,135, Jul. 2, 1984, abandoned.

[51] Int. Cl.[4] ..... B22D 27/02

[52] U.S. Cl. ..... 164/466; 164/502; 164/503; 164/467

[58] Field of Search ..... 164/464, 465, 502, 503, 164/504, 466, 467, 468, 421, 422

[56] References Cited

U.S. PATENT DOCUMENTS

| | | | |
|---|---|---|---|
| 4,126,175 | 11/1978 | Getselev | 164/467 X |
| 4,414,285 | 11/1983 | Lowry et al. | 164/466 X |
| 4,495,981 | 1/1985 | Kindlmann et al. | 164/467 |

FOREIGN PATENT DOCUMENTS

| | | | |
|---|---|---|---|
| 0050581 | 4/1982 | European Pat. Off. . | |
| 2352612 | 12/1977 | France . | |
| 2414969 | 8/1979 | France . | |
| 48-5413 | 2/1973 | Japan | 164/502 |
| 288934 | 3/1971 | U.S.S.R. | 164/464 |
| 2048139 | 10/1980 | United Kingdom . | |

*Primary Examiner*—Kuang Y. Lin

*Attorney, Agent, or Firm*—Charles W. Helzer

[57] ABSTRACT

Dense, homogeneous tubular metal products such as pipe is cast in long lengths continuously by introducing liquid metal into the lower portion of an annular-shaped casting vessel. The liquid metal is withdrawn in the presence of an outer elongated upwardly travelling alternating electromagnetic levitation field and a second inner electromagnetic levitation field for maintaining the tubular liquid metal column in a substantially weightless and pressureless contact condition while solidifying. The resulting solidified tubular metal product is withdrawn from the upper portion of the field, cooled and further processed to result in a desired product/and has a homogeneous, fully dense, fine grain structure due to continuous eddy current stirring by the levitating electromagnetic fields and a ripply, shiny exterior surface.

21 Claims, 2 Drawing Sheets

CONTINUOUS METAL TUBE CASTING METHOD AND APPARATUS

This application is a continuation of application Ser. No. 901,616, filed Aug. 29, 1986 and now abandoned, which application is a continuation-in-part application of U.S. patent application Ser. No. 627,135, filed July 2, 1984, for Continuous Metal Tube Casing Method, Apparatus and Product by Jeffrey Norling Peterson, inventor, now abandoned.

FIELD OF INVENTION

This invention relates to a new and improved method and apparatus for the continuous manufacture of tubular metal products, such as pipe, and to the resulting product.

More specifically, the invention relates to the continuous manufacture of tubular metal products, such as pipe, in long lengths by up-casting in the presence of electromagnetic levitating fields for minimizing gravitational, frictional and adhesive forces acting on the cast tubular metal product while still in a molten state and while maintaining maximum effective heat transfer between the tubular molten metal forming the product and the heat exchanger during solidification.

BACKGROUND PRIOR ART

Tubular metal products in the form of pipe, etc., have been produced in the past by a variety of techniques including casting which have been described in detail in the published literature relating to this art. U.S. Pat. No. 4,274,470-issued June 23, 1981 in the prior art statement thereof appearing in columns 1 and 2, for example, lists a number of prior art patents and technical articles which describe electromagnetic casting apparatus suitable for use in the fabrication of tubular metal products, such as pipe, and discusses the short-comings of these known prior art procedures. Included amongst these prior art disclosures are U.S. Pat. No. 3,467,166—Getselev, et al.; U.S. Pat. No. 3,605,865—Getselev; U.S. Pat. No. 3,735,799—Karlson; U.S. Pat. No. 4,014,379—Getselev; and U.S. Pat. No. 4,126,175—Getselev which describe the use of an electromagnetic mold to contain a pool of molten metal within specified dimensions while the pool is moving downwardly and in which outer, laterally extending portions of the pool are being solidified. In this procedure, accretion of the solidified metal is longitudinally extending and melt being delivered, either semi-continuously or continuously, is by gravity flow to the upper end of the descending pool that forms the solidifying ingot. One of the more serious drawbacks of this procedure is the fact that the "fail safe" characteristics of previously known upward casting technique, is absent. Hence, in the event of an unexpected electric power failure, etc., molten metal may spill out of the downwardly moving pool of molten metal instead of merely running back into a holding vessel as would be the case in an upward casting system. In addition, the molten metal overflow and break-out possibility in these known downward casting techniques require constant careful control of both the molten metal feed rate and the solidified ingot removal rate with both rates being drastically limited by a heat exchange problem which consequently diminishes the commercial potential for this method of continuous casting.

U.S. Pat. No. 3,746,077 to Lohikoski, et al. and U.S. Pat. No. 3,872,913 to Lohikoski, both assigned to Oytokumpo Oy of Finland, describe an upward casting technique wherein molten metal either is hydrostatically forced or pulled by vacuum upwardly into an open-ended, vertically disposed mechanical mold as freshly-formed. By this procedure cooled cast product intermittently is removed from physical contact with the upper end of the mechanical mold into which the molten metal continuously is being introduced. In this system, the desirable "fail-safe" characteristic of an upward-casting technique is attained but only at the expense of considerable wear and tear on an external contact mold which wears out in unacceptably short time periods during continuous or semi-continuous operation of the system. Thus, there is a need for an improved system of continuous casting of tubular metal product which avoids the shortcomings of the known prior art electromagnetic casting systems.

SUMMARY OF INVENTION

It is therefore a primary object of the present invention to provide a new and improved continuous up-casting method and apparatus for fabricating tubular metal products such as pipe in continuous long lengths and which overcome the shortcomings and deficiencies of the presently known and used continuous tubular metal product casting techniques and systems as discussed above.

A feature of the invention is the provision of an improved method and apparatus for the continuous manufacture of tubular metal products such as pipe in long lengths by casting the products in the presence of an upwardly travelling electromagnetic levitating and containment electromagnetic fields for minimizing gravitational, frictional and adhesive forces acting on the cast tubular metal product while maintaining maximum effective heat transfer between the solidifying tubular metal product and a heat exchanger.

In practicing the invention a method and apparatus is provided for producing tubular metal products of long length which comprises means for forming a first, outer elongated, upwardly-travelling, alternating electromagnetic levitation field within the interior of a surrounding annular-shaped casting vessel and providing a coextensive electromagnetic containment field component which is directed at right angles to the upwardly travelling levitation field. Second inner electromagnetic levitation field producing means are provided for forming at least a second electromagnetic levitation field component which acts in conjunction with the first mentioned electromagnetic levitation field on liquid metal contained within the annular-shaped casting vessel. Liquid metal is introduced into the lower portion of the annular-shaped casting vessel and the combined levitation electromagnetic fields to form a hollow tubular liquid metal column. The values of the electromagnetic levitation fields acting on the tubular liquid metal column are established by suitable control means to reduce the hydrostatic head of the column to a minimum while maintaining a predetermined dimensional relationship between the outer and inner surfaces of the tubular liquid metal column and the opposed interior surrounding surfaces of the annular-shaped casting vessel, and particularly with respect to the outer surface of the tubular liquid metal column and the interior of the outer surrounding surface of the casting vessel where the bulk of the heat is extracted. The electromagnetic fields acting on the tubular liquid metal column are so maintained by appropriate separate control of frequency and magnitude of the excitation currents supplied to respective outer and inner coils constituting the outer and inner levitating and containment electromagnetic field producing means so that the cross sectional dimension of the tubular liquid metal column is sufficiently large to provide pressureless contact but precludes formation of a substantial gap between the inner and outer surfaces of the hollow tubular liquid metal column and the opposed interior surrounding surfaces of the annular-shaped casting vessel thereby effecting pressureless contact and maximum obtainable heat transfer between the tubular liquid metal column and the casting vessel while simultaneously reducing gravitational, frictional and adhesive forces to a minimum. The tubular liquid metal column is moved upwardly through the casting vessel while thus being levitated and solidified in a solidification region surrounded by a heat exchanger and the solidified tubular metal product thereafter is removed from the upper portion of the casting vessel.

While being operated in the continuous casting mode, liquid metal is introduced continuously into the lower portion of the casting vessel and solidified tubular metal product is continuously removed from the upper portion of the vessel with the rate of production of the tubular metal product being determined by controlling the rate of removal of the solidified tubular metal product from the upper portion of the vessel and the corresponding rate of introduction of liquid metal into the lower portion of the vessel.

In a preferred embodiment of the invention, the second electromagnetic levitation field component producing means comprises a second upwardly travelling, electromagnetic levitation field producing coil disposed within the central opening of the annular-shaped casting vessel.

When initially starting the process, a starting metal tube is joined to the tubular molten metal column moving upwardly through the levitating field by cooling and solidifying the upper end of the tubular liquid metal column within the fields to the lower end of the starting metal tube within the solidification zone. Means are provided for withdrawing the starting lifting tube and attached solidified tubular metal product at a rate which determines the rate of production of the tubular metal product. The withdrawn tubular metal product is precooled as it emerges from the upper portion of the casting vessel and if desired thereafter reduced in diameter while hot and subsequently cooled to an ambient temperature. Alternatively, if initially cast in a desired dimension, the tubular metal product as it emerges from the upper portion of the casting vessel is precooled and thereafter further cooled to ambient temperature and further processed while cold.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the figures are identified by the same reference character, and wherein.

BEST MODE OF PRACTICING THE INVENTION

U.S. Pat. No. 4,414,285—issued November 8, 1983 for a "Continuous Metal Casting Method, Apparatus and Product"—Hugh R. Lowry and Robert T. Frost—inventors, assigned to the General Electric Company discloses a novel continuous metal casting method, apparatus and product for casting dense homogeneous solid metal rod in long lengths by introducing liquid metal into the lower portion of a casting vessel in the presence of an elongated upwardly-travelling alternating electromagnetic levitation field. The present invention is an improvement in Pat. No. 4,414,285 in that it discloses a method and apparatus for extending the principle taught in Pat. No. 4,414,285 to the manufacture of tubular metal products in the form of pipe, etc.

Figure 1:
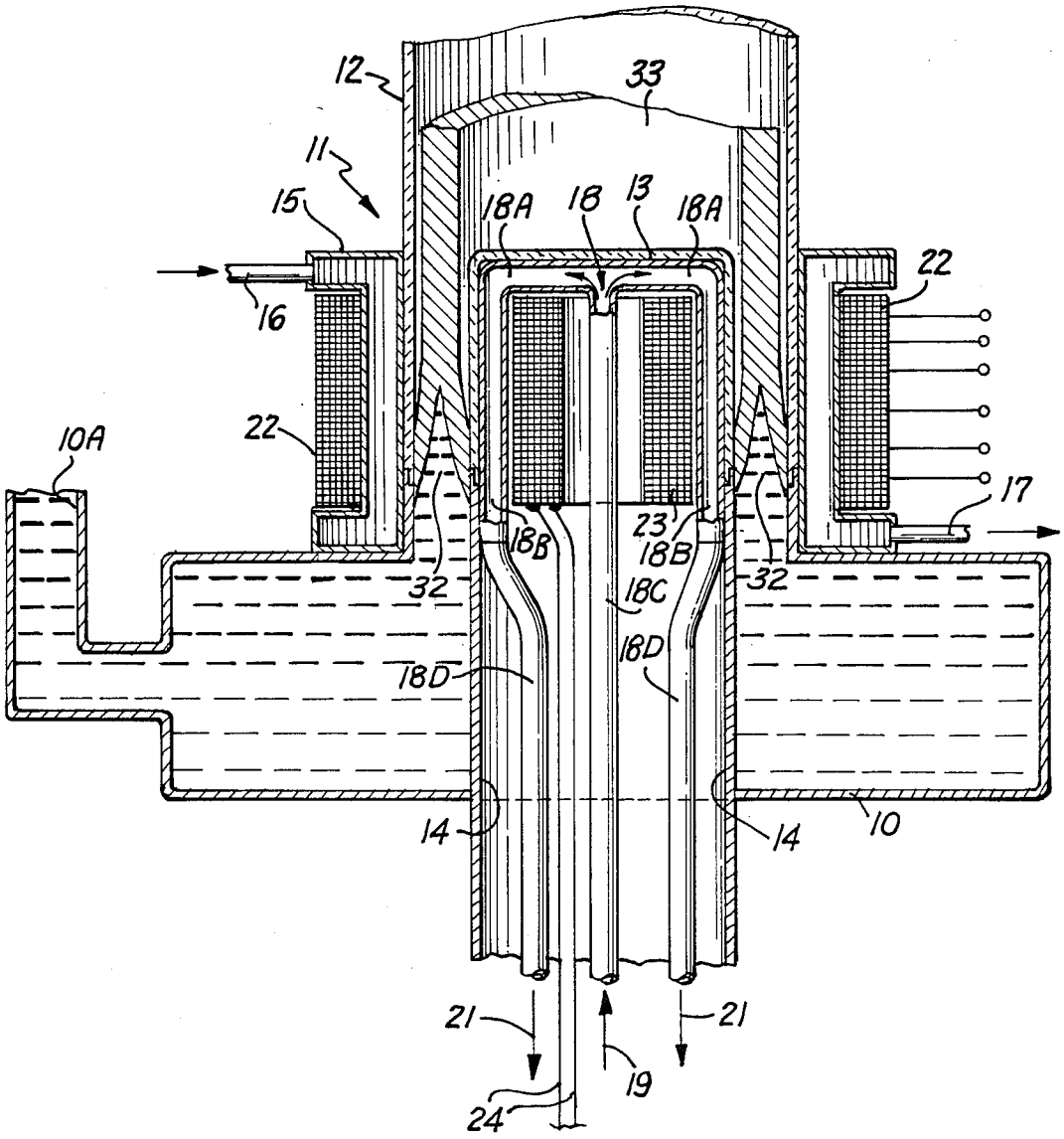
FIG. 1 is a partial, schematic functional diagram of a new and improved tubular metal product electromagnetic levitation casting apparatus according to the invention and illustrates the important elemental parts of the apparatus and their inter-relationship in fabricating tubular metal products according to the invention.

FIG. 1 is a functional diagrammatic sketch of a modified apparatus suitable for producing tubular metal products of long length in a continuous manner in accordance with the present invention and employing the principles disclosed in U.S. Pat. No. 4,414,285. The apparatus shown in FIG. 1 is comprised by an annular-shaped molten metal reservoir 10 into which is supplied molten metal through inlet 10A under pressure of a covering gas (or by gravity flow) out of which the pipe of other tubular metal product is to be fabricated. It is understood that the molten metal reservoir 10 will be provided with suitable refractory liner insulation and heating elements for maintaining the molten metal contained therein in a molten state. An annular-shaped combined casting vessel/heat exchanger shown generally at 11 is disposed on the upper end of reservoir 10 with the annular-shaped interior passageway of the annular-shaped casting vessel/heat exchanger 11 being aligned with and having access to a correspondingly shaped opening in the top of molten metal reservoir 10.

The annular-shaped casting vessel/heat exchanger 11 is comprised by an outer cylindrically-shaped liner 12 which is supported on and projects into the annular passageways formed in the top of reservoir 10. An inner ceramic, mandrel lining 13 is formed in the shape of an upside down cup disposed over a central opening 14 formed in the center of the annular-shaped molten metal reservoir 10. The side walls of the inner cup liner 13 in conjunction with the outer liner 12 define an elongated annular-shaped casting vessel in which the molten metal in reservoir 10 is to be solidified in the form of a desired tubular metal product such as pipe.

Disposed around the outer liner 12 in the region immediately above the molten metal reservoir 10 is a first outer annular-shaped heat exchanger 15 which provides the principal heat extraction function for the tubular casting assembly and may be constructed and operated in the same manner as the heat exchanger shown and described with relation to FIG. 3 of U.S. Pat. No. 4,414,285, the disclosure of which is hereby incorporated into this application in its entirety. Cooling water or other fluid is supplied to the heat exchanger 15 through an inlet indicated by the arrow 16 and heated water or other cooling fluid is withdrawn from the heat exchanger from an outlet indicated by an arrow 17.

A second, internal annular-shaped, mandrel heat exchanger 18 also is physically disposed immediately adjacent the interior surfaces of the inner cup-shaped liner 13 for withdrawing heat away from liner 13 at least to the extent required to keep the interior of mandrel liner 13 sufficiently cool to assure safe operation of an electromagnetic levitation coil mounted therein. The internal mandrel heat exchanger 18 is designed with an upper header portion 18A which seats against the bottom surface of the upside down cup-shaped liner 13 and feeds cooling water or other fluid down through the downwardly depending side portions 18B. The downwardly depending side portions 18B contact and withdraw heat away from the downwardly depending side portions of the upside down cup liner 13 that in conjunction with outer cylindrically-shaped liner 12 define the annular-shaped casting vessel in which the tubular products are formed and solidify (in the solidification zone). Cooling water or other fluid is supplied to the header portion 18A through a central inlet pipe 18C that branches in the manner shown by the arrows 19 and 21 to supply the downwardly depending side portions 18B of the inner mandrel heat exchaner 18. The entire structure is supported physically within the central opening 14 of the annular-shaped molten metal reservoir 10 by suitable physical supports (not shown).

It will be appreciated that cooling water supplied to the inner heat exchanger 18 via the central conduit 18C as indicated by the inlet arrow 19, will be limited in quantity due to size constraints imposed by its physical location. The cooling water or other fluid circulates through the header portion 18A and then is withdrawn via the downwardly depending cup side portions 18B and outlet conduits 18D which drain the side portions 18B as indicated by the outlet arrows 21. The amount of cooling achieved with the inner mandrel heat exchanger 18 is sufficient to maintain the interior of the heat exchanger 18 at a temperature which assures safe operation of an inner mandrel electromagnetic levitation coil 23 (to be described hereafter) which is physically supported within the inner mandrel heat exchanger 18. Substantially all of the heat extraction required to solidify the cast tubular metal product within the solidification zone of the annular casting vessel/heat exchanger 11 takes place through the first outer heat exchanger 15 which is not constrained in size because of its location and hence can be designed to provide adequate cooling of the molten metal to form solidified hollow tubular metal product within the solidification zone.

Figure 2:
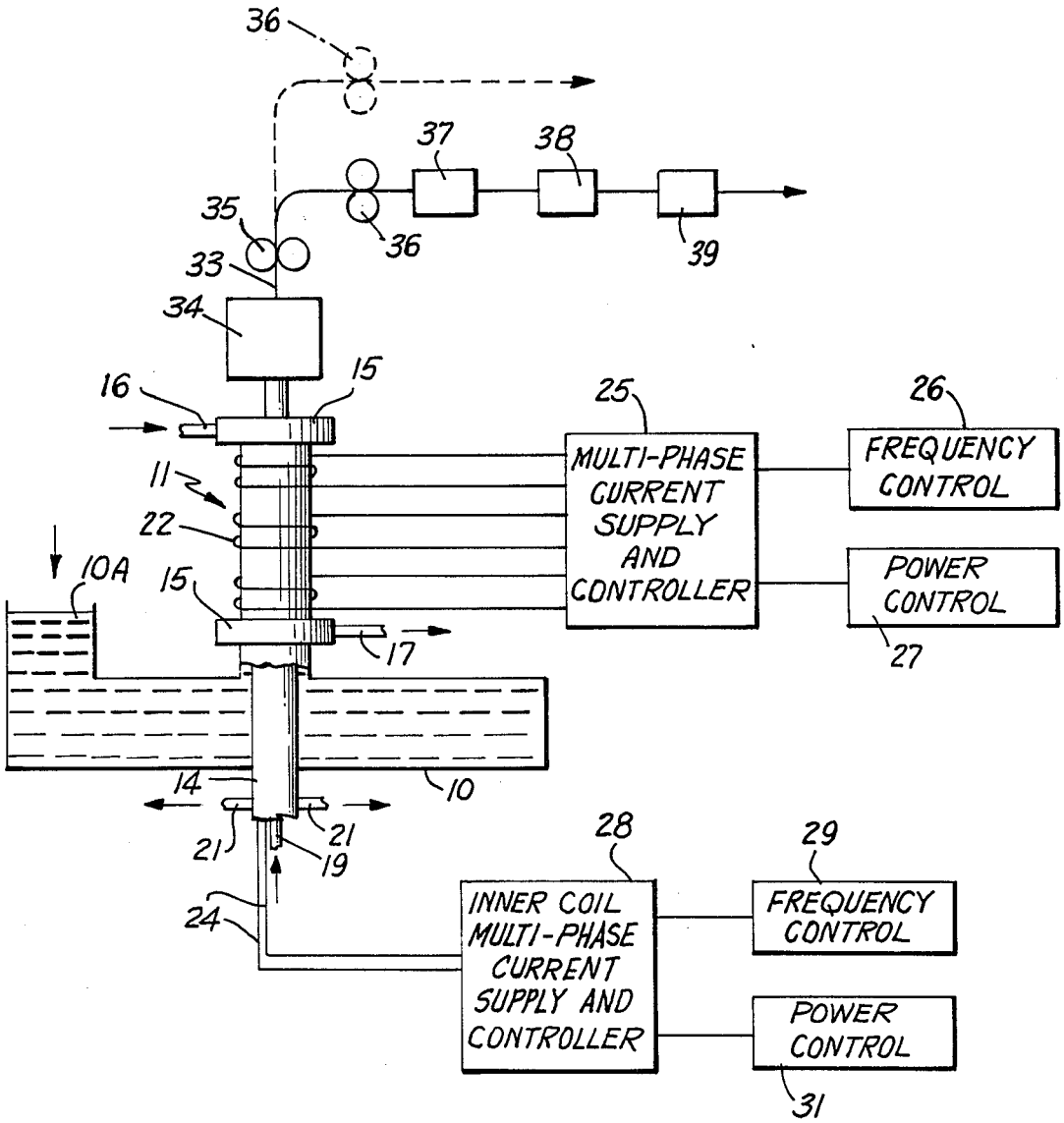
FIG. 2 is a functional block diagram of an overall continuous casting system according to the method of the invention and which employs the apparatus shown in FIG. 1.

An outer multi-turn, electromagnetic levitation coil winding 22 circumferentially surrounds the exterior of the outer heat exchanger 15 in the manner shown in FIG. 1. The outer multi-turn coil 22, for example, may comprise twelve coils disposed in vertical spaced relationship around the outer ceramic liner 12 with the planes of the windings arranged substantially normal to the axis of the ceramic liner tube 12. As explained more fully in the above-referenced U.S. Pat. No. 4,414,285, and specifically with relation to FIG. 3 thereof, the respective coils of the multi-turn winding 22 are connected in groups of three to successive phases of a polyphase electric current source such as shown in FIG. 2 of the drawings to create a first upwardly travelling outer electromagnetic levitation field and a significant, coextensive electromagnetic containment field component directed inwardly substantially at right angles to the upwardly travelling levitation field that act on the liquid metal within the solidification zone of the tubular casting vessel/heat exchanger 11.

A second, inner multi-turn winding coil shown at 23 is provided with the individual coils of the multi-turn winding lying in planes at right angles to the central axis of the inner ceramic, inverted cup mandrel liner 13. The insulated coils of winding 23 are circumferentially wound around the interior surface of the side skirts 18B of the interior inverted cup-shaped heat exchanger 18. Supply electric current is provided to the interior multi-turn windings 23 via supply conductors 24. The inner, multi-turn windings 23 preferably are excited with multi-phase currents to provide a second, inner upwardly travelling electromagnetic levitation field acting on the tubular liquid metal contained within the annular-shaped casting vessel/heat exchanger 11 in addition to the first, outer, upwardly travelling electromagnetic levitation field. In the preferred embodiment of the invention, the inner, multi-turn coil 23 is connected as a multi-phase winding that is supplied with polyphase currents via the supply conductors 24. This results in the production of an additional upwardly travelling electromagnetic levitation field which is substantially at the same frequency and in phase with the upwardly travelling levitation field produced by the outer multi-turn coil 22 and produces substantially the same levitating field force effect. Coil 22 also has a containment field component that extends outwardly in a direction at right angles to the upwardly travelling levitation fields and acts to exert an outward pressure on the interior sidewalls of the tubular molten metal within the solidification zone.

Numerous experiments in the laboratory and in an electromagnetic casting pilot plant confirm that the system of Pat. No. 4,414,285 leads to production of uniform, ductile long lengths of rod of various metals and alloys. This is due to the fact that adjustment of the levitation forces supplied by the electromagnetic levitator to reduce the hydrostatic head due to weight forces of the liquid metal in the solidification zone eliminates problems of sticking and mold wear.

Another claim of the reference patent, namely that the levitation force density averaged over the liquid metal column radius must be adjusted to the same order as the weight force density $\rho g$, where $\rho$ is the density of the metal being cast and g the acceleration of gravity, has also been confirmed in numerous experiments, although (as mentioned in the above-noted patent) there is some tolerance on the exact value of the levitation forces. The levitation forces diminish as one considers volume elements from the liquid metal surface to positions within the column, and the attenuation length of these forces is of the order of the electromagnetic skin depth which generally will be of the order of the column radius or shorter. It follows that the levitation forces near the outer surfae of the liquid metal column will considerably exceed the average force density and thus will exceed the value $\rho g$.

As an example which is representative of the qualitative improvement to be obtained in the preferred mode of implementation of the electromagnetically excited mandrel to produce hollow shapes according to the subject application, the unique advantages of excitation of the mandrel coils in an upward travelling levitation wave mode as compared to monophase excitation can be seen by consideration of the pressures exerted by the solidifying liquid metal on the inner surface of the outer casting vessel 12 and the external surface of the inner mandrel 13. If we denote these pressures by po and pi, respectively, we can compare the two pressures for the cases where the electromagnetic forces provided by the mandrel coil are excited either by a monophase non-levitating containment coil system or a polyphase fed upwardly travelling levitating coil system.

Since the liquid metal feed to the lower portion of the coil system is adjusted to be near ambient atmospheric pressure, the gauge pressure at a height h above this region will be approximately $po=(\kappa-\rho g)h$ above atmospheric pressure where $\kappa$ is the levitation force density near the outer surface of the liquid metal. As discussed above, because the average value of levitation force density over the radius of the metal column must be adjusted to be approximately equal to $\rho g$, because of the skin depth phenomenon, the value k at the outer liquid metal surface must be considerably higher than $\rho g$. Thus levitation of the gross weight of the solidifying liquid metal column to prevent cavitation at the upper end of the solidification zone can lead to undesirably high contact pressures at the outer liquid metal surface.

Without any electromagnetic excitation of the mandrel, the pressure pi at the inner liquid metal surface adjacent to the mandrel would be higher than po by the integral of the radially inward forces over the annular thickness of the liquid metal column. The claim of Getselev (U.S. Pat. No. 4,126,175) is essentially that monophase excitation of a coil within the mandrel can exert radial forces in the opposite direction and thus reduce the pressure at this inner surface to approximately the same value as that at the outer surface. This assumes approximately equal radial gradients of the square field strength $B^2$ for the outer coil and the inner mandrel coil, and that these gradients act over approximately equal skin depths.

If on the other hand, the coil within the mandrel is excited with polyphase currents so as to produce an upwardly acting levitation electromagnetic force density near the mandrel surface approximately equal to that furnished by the outer coil at the outer surface, the pressure at both surfaces can be significantly reduced as can be seen by the following calculations.

Numerous calculations by us have shown that, for efficient electromagnetic levitation casting in a continuous casting apparatus, the frequency must be adjusted so that the electromagnetic skin depth $\delta$ is of the order of the radial thickness of the liquid metal column being solidified. For a solid rod this thickness is the rod radius; for a pipe or other tubular hollow shape this is the annular thickness of the pipe or tube. Since the levitation forces from the outer levitation coil fall off approximately exponentially at the electromagnetic skin depth, the average levitation force density averaged over the annular thickness will be less than the levitation force density at the outer surface by a factor $$\frac{1}{\delta}\int_{o}^{\delta} e^{-r/\delta}\,dr = 1 - e^{-1} = 0.63 \qquad (1)$$

where r is the radial thickness of the tubular shape. Thus in order to provide total levitation forces equal to the weight of the annular column, the levitation force density k at the outer surface must exceed the weight density $\rho g$ by a factor $(0.63)^{-1}=1.58\ \rho g$.

If, on the other hand, the mandrel electromagnetic coils produce an upwards travelling electromagnetic wave with a resultant levitation lifting force density at the mandrel surface equal to that produced at the outer surface of the liquid metal column by the outer levitation coils, the levitation force densities at the outer and inner liquid metal surfaces can be adjusted to a new value $m\rho g$, where the multiple m is calculated so as to provide an average levitation force equal to $\rho g$ due to both fields over the annular wall thickness. The average force density will now be $2(1-e^{-1})m=1.26m$. Since the levitation force density at each surface will be the sum of that due to the nearest coil plus that due to the other coil at a distance approximately one skin depth removed, the value of the surface force densities will be approximately $m(1+e^{-1})\simeq 1.36m$. The value of excitation can now be adjusted so that $1.26m=\rho g$ with the result that the surface force density is $1.36m=(1.36/1.26)\rho g=1.08\ \rho g$. This is to be compared to the value calculated above in the absence of an upwardly travelling wave levitation excitation, where a monophase excitation is used for the inner mandrel coil, of $1.58\rho g$. We thus see that providing an upwardly travelling wave levitation excitation for the internal coil of the mandrel can reduce the net pressure at both surfaces by a factor $(1.58\ \rho g-\rho g)/(1.08\ \rho g-\rho g)=(0.58/0.08)\simeq -7$. This reduction will be particularly important for high solidification rates, where the height of the solidification zone would lead to a substantial net pressure between the liquid metal and the mandrel in the absence of an inner mandrel upwardly travelling electromagnetic levitation field.

FIG. 2 of the drawings shows the exterior multi-turn coil 22 connected to a multi-phase current supply and controller 25 which in turn may be independently controlled in frequency by a frequency control 26 and independently controlled in power level output by a power control 27 all of conventional, known construction. Similarly, the inner multi-turn coil 23 of FIG. 1 is connected via supply conductors 24 to an inner coil multi-phase current source and controller 28 having an independent frequency control 29 and an independent power control 31 for controlling the frequency value and current magnitude (power) of the supply current supplied by controller 28 to the inner multi-turn coil windings 23. As stated above, the multi-turn coil 23 comprises a multi-phase winding similar to the exterior multi-phase winding 22 and the current supplied by controller 28 via supply conductors 24 is a multi-phase current capable of producing an inner upwardly travelling electromagnetic levitation field. This inner electromagnetic levitation field preferably is substantially at the same frequency and levitation field force density power level and if the frequencies are the same substantially in-phase with the upwardly travelling levitation field produced by the external multi-turn coil 22, consistent with maintaining separate control over the frequency and magnitude of the excitation currents supplied to the respective coils 22 and 23. The inner leviation field also and has a containment field component that is substantially at right angles to the upwardly travelling levitation fields and acts in a direction to tend to push the inner surface of the tubular liquid metal column away from the outer side skirts of the inner ceramic mandrel liner 13.

In operation, molten metal prepared in a holding furnace (not shown) is supplied to the reservoir chamber 10 via an inlet 10A by means for supplying and controlling introduction of liquid metal from the holding furnace into chamber 10 by controlled gravity pouring, or by pressurization with an inert gas cover in a known manner. The liquid metal in chamber 10 is displaced from the reservoir upwardly into the lower portion of the annular casting vessel defined by the opposed interior surfaces of the outer ceramic liner 12 and the exterior depending skirt surfaces of the inverted ceramic cup liner 13. The arrangement is such that either by gravity flow or due to pressurization by an inert gas cover, the molten metal shown at 25 is caused to rise within the annular casting vessel defined between ceramic walls 12 and 13 to a level just above the lower ends of the outer and inner sets of multi-turn coils 22 and 23. The holding furnace and its associated molten metal supply system (not shown) is designed to controllably deliver inlet molten metal into reservoir chamber 10 either intermittently or continuously as necessary during continuous operation of the process in order to maintain this starting level of molten metal within the annular-shaped casting vessel 12, 13. At this level, the molten metal will come under the influence of the upwardly travelling electromagnetic levitation fields produced by the exterior coil 22 and that produced by the interior multi-turn coil 23.

During initial start-up, a starter lifting tubular member (not shown) is introduced from the upper end of the annular-shaped casting vessel 12, 13, and the lower end of the starter tube is brought into contact with the top of the tubular liquid metal column formed by the rising molten metal within the annular-shaped casting vessel 12, 13. With cooling water or other fluid running at full velocity through the respective heat exchangers 15 and 18, the upper portion of the tubular liquid column shown at 26 will be solidified in contact with the starter tubular member. The starter tubular member and accreted solidified tubular column 26 then will be withdrawn upwardly from the annular-shaped casting vessel 12, 13 by suitable withdrawal rolls 35 and 36 as shown in FIG. 2. The starter tube and accreted tubular metal column 26 will be withdrawn at a rate determined by the rate of formation of tubular metal product and which in turn determines the rate of production of the continuous casting system. During solidification within the solidification zone defined essentially by the length of the multi-turn coils 22 and 23, the liquid metal column both in its molten and solidified form will be maintained in a substantially weightless and pressureless condition by the upwardly travelling, electromagnetic levitation fields as explained more fully in the above-referenced and incorporated U.S. Pat. No. 4,414,285.

During operation, the tubular liquid metal column within the solidification zone and during levitation in the above described manner, becomes subject to a unique and unexpected self-regulating characteristic. Due to this self-regulating characteristic, if the tubular liquid metal column is accelerated upwards because the levitation force is greater than the weight force of the liquid metal column, it produces a reduction in cross-sectional area of the column. This then results in an automatic reduction in the lifting force as a consequence of the reduction of the cross section of the liquid metal column caused by the greater levitation force. Consequently, a slowing of the upward movement of the tubular liquid metal column automatically will occur so that the system stabilizes itself and becomes self-regulating. The opposite situation also is true in that if the tubular metal column is decelerated due to a reduction in the levitation force, there will be an increase in the cross section of the tubular liquid metal column which results in increasing the levitation force acting on the column and thereby accelerating the upward movement of the tubular liquid metal column. Thus, within the levitation zone (i.e. the zone where the upwardly travelling electromagnetic levitation fields act on the tubular metal column either in its molten or solidified state), it will be seen that the system is inherently self-regulating once it is placed in operation to effect substantially weightless and pressureless levitating support of the solidifying tubular liquid metal column within the solidification zone as described above.

While the full effect of the levitation electromagnetic field applies to a large part of the length of the tubular liquid metal column and the solidified tubular metal product within the solidification zone, the part of the column in the lower and upper extremities of the solidification zone (where levitation forces average only about one-half of the those produced in the central portion of the zone) is supported, respectively, by the pressure head provided to raise the liquid column to an intital height and by the lifting force applied through the starter tube described earlier. Thus, as the tubular liquid metal column is being established, a small upward acceleration is provided by those lower end region levitation forces, but as the liquid metal column moves upwardly so that it is within the central portion of the levitation zone, it enters fields strong enough to establish and maintain the column in an essentially weightless condition so that any contact with the walls 12 and 13 of the annular-shaped casting vessel becomes substantially pressureless. By pressureless, it is meant that there is no substantial continuous pressure contact between the inner and outer surfaces of the liquid metal column and the interior surrounding surfaces of the annular-shaped casting vessel 12, 13 and the tubular liquid metal column is without substantial hydrostatic head in the critical solidification zone and gravitational, frictional and adhesive forces acting on the solidifying metal column are reduced to a minimum in this critical zone.

The inside diameter of the outside cylindrical ceramic liner 12 and the outside diameter of the cylindrical depending skirt portion of inner ceramic cup liner 13 are so designed that there is a minimum annular gap between the exterior surface of the tubular liquid metal column 25 and the opposing surfaces of the ceramic liners 12, 13. This gap should be as small as possible and may not be a continuous gap but instead may be a sporadically or randomly occuring open space between the exterior surfaces of the tubular metal column and side walls of the casting vessel, typical of a pressureless contact condition, but is too small to be shown in the drawings since it is important for good heat transfer to maintain the dimensions of this gap to a very small value. However, an attempt was made to illustrate the place where the gap occurs in FIGS. 2 and 3 of the above-referenced and incorporated U.S. Pat. No. 4,414,285 keeping in mind that the illustration is schematic and not intended as an actual representation of the locations or dimensions of the gap. The gap does occur however randomly and erratically and its existence is evidenced by the exterior surface of the resultant solidified tubular metal product which has a shiny wavy exterior appearance.

The gap between the outer surface of the tubular metal column and the outer sidewalls of the casting vessel 12, if allowed to become too large due to the containment componenet of the outer, upwardly travelling levitating electromagnetic fields, could seriously impair effective heat transfer between the tubular liquid metal column and the opposing side surface of the outer ceramic liner 12. This should not be allowed to happen since there is known to be a strong inverse relationship between field strength and heat removal rate. Consequently, the frequency and levitation field force density of outer coil 22 and inner coil 23 should be adjusted at the start of a casting operation to provide the desired pressureless contact as defined above with minimum gap spacing consistant with good thermal transfer. The field strength then should be maintained at this setting and should not be changed during the casting operation even though the rate of removal (line speed) of the tubular liquid metal column through the solidification zone region might be changed.

Referring to FIG. 2 of the drawings, it will be seen that as the solidified tubular metal product is withdrawn from the upper end of the levitator tube assembly 11 and through a pre-cooling chamber 34 by two sets of withdrawal rolls 35 and 36 and delivered to two tandem hot-rolling stations 37 and 38, cooled and then further coiled at a coiling station 39. Alternatively, if the solidified tubular metal product 33 has the right diameter for use (with or without cold drawing) in an as-cast condition, it is withdrawn from the pre-cooling chamber 34 by withdrawal rolls 35 and 36 and delivered for subsequent cooling and coiling. As explained more fully in U.S. Pat. No. 4,414,285, column 11, lines 3–20 the upwardly travelling electromagnetic levitating fields also electromagnetically stir the liquid metal and this stirring by means of eddy currents induced in the liquid metal results in a dense, homogeneous solidified product having fine grain structure.

During operation the casting speed (i.e., the line speed of the tubular liquid metal column passing through the heat exchanger/levitator assembly 11) should be controlled by control of the drive motors for the tubular rod removal rolls 35 and 36 which are sychronized with the rolling mills 37 and 38 and the coiling mechanism 39. The levitation field strength and excitation frequency should be established at a value calculated for the particular size and resistivity of the tubular metal being cast to give a levitation ratio in range between 75% and 200% where levitation ratio is defined as the ratio of the levitation force per unit of length of the liquid metal to the weight per unit length of the liquid metal as explained in U.S. Pat. No. 4,414,285 at the bottom of column 11 and the top of column 12. The frequency should be in excess of one kilohertz as explained in U.S. Pat. No. 4,414,285, column 13, line 24 through column 15, line 26.

In a practical process and system employing the invention, the electromagnetic levitation casting system would be started at lower than normal line speed and higher than normal levitation ratios in order to insure reliable start-up. After reaching steady-state operating conditions (within two to three minutes) the line speed then would be increased manually in steps and the levitation field strength decreased in steps until close to a maximum casting rate is achieved in terms of tons per hour of conversion of molten metal to the solidified tubular metal product. The system then is maintained at this setting during the course of the run. Normally, it would be desirable to monitor the temperature of the emerging solidified tubular metal product by monitoring the product as it exits the annular-shaped casting vessel/heat exchanger 11 either visually or with a pyrometer to assure successful production runs.

INDUSTRIAL APPLICABILITY

The invention makes available a novel method and apparatus for continuously casting tubular metal products such as pipe in the presence of upwardly travelling levitating electromagnetic fields which cooperate to greatly reduce the forces required to extract solidified tube as well as reduce wear and tear on the machinery normally employed in the casting of such products.

Having described a method and apparatus and resulting solidified tubular metal product according to the invention, it is believed obvious that other modifications and variations of the invention will be suggested to those skilled in the art in the light of the above teachings. It is therefore to be understood that changes may be made in the particular embodiment of the invention described which are within the full intended scope of the invention as defined by the appended claims.

What is claimed is:

1. The method of producing hollow tubular metal products of long length which comprises the steps of forming an outer elongated upwardly-travelling alternating electromagnetic levitation field within the interior of a surrounding annular-shaped casting vessel having an inner and outer mandrel surface together with a significant coextensive electromagnetic containment field component directly inwardly substantially at right angles to the outer upwardly travelling levitation field, said outer upwardly-travelling electromagnetic levitation and inwardly directed containment fields being produced by an outer multi-phase winding surrounding the exterior of the annular-shaped casting vessel and supplied from a separately controllable multi-phase current supply whose output current magnitude and frequency is variably controllable; forming a second, inner elongated upwardly travelling alternating electromagnetic levitation field acting in an upward direction together with a significant coextensive electromagnetic containment field component extending outwardly from the outer mandrel surface substantially at right angles to the inner upwardly travelling electromagnetic levitation field within the center of the annular-shaped casting vessel, said inner upwardly travelling electromagnetic levitation and outwardly directed containment fields being produced by an inner multi-phase winding located within the the interior of the mandrel and supplied from a separately controllable multi-phase current supply whose output current magnitude and frequency is variably controllable; introducing liquid metal into the lower portion of the annular-shaped casting vessel and the combined upwardly travelling electromagnetic levitation and containment fields to form a tubular hollow liquid metal column; controlling each of the multi-phase current supplies at substantially the same frequency to establish substantially equal values of electromagnetic levitation and containment field force densities acting on the hollow tubular liquid metal column to reduce the hydrostatic head of the column to a minimum while maintaining pressureless contact by establishing a slight gap between the outer and inner surfaces of the hollow tubular liquid metal column and the opposed interior surrounding surfaces of said annular-shaped casting vessel; maintaining the frequency and current magnitude of the respective multi-phase current supplied to the outer and inner multi-phase windings so that the inner and outer upwardly travelling electromagnetic levitation fields and their coexisting containment field components maintain the crosssectional dimensions of the hollow tubular liquid metal column at values to provide pressureless contact due to the presence of the slight gap but precluding formation of a substantial gap between the outer and inner surfaces of the hollow tubular liquid metal column and the opposed interior surrounding surface of the outer and inner side walls of the annular-shaped casting vessel thereby providing pressureless contact and effective heat transfer between the hollow tubular liquid metal column and the casting vessel sufficient to solidify metal while simultaneously reducing gravitational, frictional and adhesive forces to a minimum; moving the hollow tubular liquid metal column upwardly through the casting vessel; solidifying the metal while moving upwardly through said vessel and said electromagnetic levitation and containment fields; and removing solidified hollow tubular metal product from the upper portion of the casting vessel.

2. The method of claim 1 operated in the continuous casting mode in which liquid metal is introduced continuously into the lower portion of the casting vessel and solidified hollow tubular metal product is continuously removed from the upper portion of said vessel, and the rate of production of the hollow tubular metal product is determined by controlling the rate of removal of the solidified metal product from the upper portion of the vessel and controlling the corresponding rate of introduction of liquid metal into the lower portion of the vessel.

3. The method of claim 2 in which the tubular liquid metal column extending upwardly through the electromagnetic levitation fields is maintained at the point of weightlessness so that it is substantially without hydrostatic head over a major part of its length in said fields and the outer and inner electromagnetic levitation fields are at the same frequency and substantially in-phase and the cross sectional dimensions of the tubular liquid metal column is maintained at values to prevent substantial continuous pressure contact between the inner and outer surfaces of the tubular liquid metal column and the interior surrounding surfaces of the annular-shaped casting vessel so that the tubular liquid metal column is without substantial hydrostatic head thereby reducing gravitational, frictional and adhesive forces acting on the solidifying tubular metal column to a minimum without impairment of heat transfer between the outer surrounding casting vessel side walls and the solidifying metal column within the solidification zone.

4. The method of claim 3 in which as a step in the initial stage of the process a starting hollow metal tube is joined to the hollow tubular molten metal column moving upwardly through the combined inner and outer upwardly travelling levitation and respective inwardly and outwardly directed containment electromagnetic fields by cooling and solidifying the upper end of the hollow tubular liquid metal column within the field to the lower end of a starting hollow metal tube.

5. The continuous casting method of producing hollow tubular metal product of long length which comprises the steps of forming a hollow tubular liquid metal column within an annular casting vessel; advancing the hollow tubular liquid metal column into a solidification zone of the casting vessel; simultaneously controlling the current magnitude and frequency of current supplied from respective separately controllable multiphase current supply and controllers for the respective outer and inner levitating and containment field producing means for electromagnetically maintaining a substantial part of the length of the hollow tubular liquid metal column in said solidification zone electromagnetically levitated with an outer electromagnetic levitation and inwardly directed containment field and an inner electromagnetic levitating and outwardly directed containment field to reduce the hydrostatic head of the column and to electromagnetically contain the column thereby establishing a predetermined dimensional relationship between the outer and inner surfaces of the hollow tubular liquid metal column and the surrounding interior surfaces of the outer and inner side walls of the casting vessel; establishing the current magntitude and frequency of the current supplied by the respective separately controllable multi-phase current supply and controllers at a value so that the outer and inner electromagnetic levitation and containment fields maintain the cross sectional dimension of the liquid metal column less than the cross sectional dimension of the annular casting vessel and forms a slight gap but prevents formation of a substantial gap between the outer and inner surfaces of the hollow tubular liquid metal column and the surrounding interior surfaces of the outer and inner side walls of the annular casting vessel thereby effecting pressureless contact while providing sufficient heat transfer between the hollow tubular liquid metal column and the casting vessel to assure solidification and simultaneously reducing gravitational, frictional and adhesive forces to a minimum; and removing solidified hollow tubular metal product from said solidification zone as the column is being eletromagnetically contained and maintained in a levitated state.

6. The method of claim 5 in which the major portion of the length of the hollow tubular liquid metal column in the solidification zone is electromagnetically maintained with a predetermined dimensional relationship between the inner and outer surfaces of the hollow tubular liquid metal column and the interior surrounding surfaces of the casting vessel such that the side surfaces of the hollow tubular liquid metal column are in pressureless contact with the interior surfaces of the annular casting vessel and preclude substantial continuous pressure contact between the inner and outer surfaces of the hollow tubular liquid metal column and the surrounding side surfaces of the casting vessel and the column is without substantial hydrostatic head to thereby reduce gravitational, frictional and adhesive forces acting on the solidifying hollow tubular metal column to a minimum without substantial impairment of heat transfer between the surrounding casting vessel and the solidifying hollow tubular liquid metal column.

7. The method of claim 6 wherein the hollow tubular liquid metal column is continuously formed and advanced into the solidification zone and in which the solidified hollow tubular metal product is continuously removed from the said zone by withdrawal means other than said levitating electromagnetic fields to thereby control the rate of production of the solidified hollow tubular metal product.

8. The method of claim 7 wherein the upwardly travelling electromagnetic levitation fields have a frequency in excess of one kilohertz.

9. The method according to claim 7 wherein the strength of the electromagnetic upwardly travelling levitation fields is set in accordance with the type and size of hollow tubular metal product being cast to provide a levitation ratio of from 75% to 200% of the weight per unit length of the liquid metal.

10. Continuous hollow tubular metal product casting apparatus comprising an elongated annular-shaped tubular casting vessel disposed in upright position to receive liquid metal for solidification; means for delivering liquid metal into a lower portion of the annular-shaped casting vessel to thereby form a hollow tubular liquid metal column; heat exchange means associated with the vessel for cooling and solidifying the hollow tubular liquid metal column therein; means for removing solidified hollow tubular metal product from an upper portion of the vessel; outer electromagnetic levitation and inwardly directed containment field producing means disposed around the outside of the annular-shaped casting vessel along a portion of its length; inner electromagnetic levitation and outwardly directed containment field producing means disposed within the center of the annular-shaped vessel for producing a second inner upwardly travelling electromagnetic levitation and outwardly directed containment field in addition to the first outer electromagnetic levitation and inwardly directed containment field produced by said outer electromagnetic levitation and containment field producing means; respective separately controlled multi-phase current supply and controller means whose output current magnitude and frequency is variably controllable connected to respective ones of said outer and inner electromagnetic levitating and containment field producing means, said outer and inner electromagnetic levitating and containment field producing means upon being supplied with a desired magnitude and frequency current from their respective multi-phase supply and controllers serving to reduce the hydrostatic head of the hollow tubular liquid metal column and maintaining a pressureless contact condition by establishing a slight gap between the outer and inner surfaces of the hollow tubular liquid metal column and the surrounding surfaces of the annular-shaped casting vessel, each of said respective multi-phase current power supply and controller means being separately controlled to maintain the value of the outer and inner electromagnetic levitation and containment fields so that the cross sectional dimensions of the hollow tubular liquid metal column is sufficiently large to preclude formation of a substantial gap between the outer surfaces of the hollow tubular liquid metal column and the surrounding interior surfaces of the outer and inner side walls of the annular-shaped casting vessel thereby providing sufficient heat transfer between the hollow tubular liquid metal column and the annular casting vessel to assure solidification while simultaneously reducing gravitational, frictional and adhesive forces to a minimum; means independent from said outer and inner electromagnetic levitation and containment field producing means for moving the hollow tubular liquid metal column upwardly through the casting vessel; and means for removing the solidified hollow tubular metal product from the upper portion of the vessel.

11. The apparatus of claim 10 wherein both the outer and inner electromagnetic levitation and containment field producing means each comprise a plurality of electromagnetic coils for connection to successive phases of a polyphase electric current source for producing the first and second upwardly travelling alternating electromagnetic field.

12. The apparatus of claim 11 further including a reservoir chamber to contain a bath of molten metal communicating with the lower end of the annular-shaped casting vessel, and means associated with the chamber to establish and move a hollow tubular column of liquid metal upwardly into the annular-shaped casting vessel to a level above the lower end of the outer and inner electromagnetic levitation and containment fields producing means.

13. The apparatus of claim 12 in which each multi-phase current supply is a three-phase generator whose output power and frequency can be set to produce a uniform and balanced upwardly travelling electromagnetic levitation force in accordance with the type and size of metal being cast.

14. The apparatus of claim 13 further including means operable during initial start-up of the apparatus for joining a hollow metal lifting tube to the top of the hollow tubular liquid metal column by contacting the top of the tubular lifting tube to the top of the hollow tubular liquid metal column while still in the solidification zone and thereafter solidifying the hollow tubular metal column to the end of the lifting tube and means for withdrawing the lifting tube and attached solidified hollow tubular metal column at a rate which determines the rate of production of the hollow tubular metal product.

15. The apparatus of claim 14 further including means for precooling the solidified hollow tubular metal product as it emerges from the upper portion of the casting vessel, means for rolling the product to a desired dimension and means for cooling the rolled product to an ambient temperature.

16. The apparatus of claim 14 further including means for precooling the solidified tubular metal product as it emerges from the upper portion of the casting vessel, and further means for cooling the pre-cooled tubular metal product to an ambient temperature.

17. Continuous casting apparatus for producing solidified hollow tubular metal product from liquid metal, comprising an annular elongated casting vessel disposed in an upright position for receiving therewithin liquid metal to be solidified; heat exchange means associated with the annular casting vessel along at least a portion of the length thereof for cooling and solidifying liquid metal in the annular casting vessel; outer and inner electromagnetic levitation and containment field producing means disposed around and within the annular casting vessel along at least a portion of the length thereof for simultaneously producing outer and inner upwardly travelling electromagnetic levitation fields for reducing the gravitational forces acting upon the liquid metal to a minimum and inwardly and outwardly directed electromagnetic containment fields for reducing frictional and adhesive forces between the side surfaces of the liquid metal and the inner side surfaces of the annular casting vessel by reducing the cross sectional area of the liquid metal thereby establishing a slight gap but precluding formation of a substantial gap between the side surfaces of the liquid metal and the interior side surfaces of the annular casting vessel so that there is no substantial reduction in the transfer of heat between the liquid metal and the heat exchange means and the metal is solidified; separately controllable multi-phase current supply and controller means connected to respective ones of the outer and inner electromagnetic levitation and containment field producing means for separately controlling the magnitude and frequency of the current supplied thereto; means independent of the levitating and containment electromagnetic field producing means for moving liquid metal upwardly into the casting vessel and within the lower portion of the electromagnetic levitating and containment fields; and means for taking away the solidified hollow tubular metal product from the upper portion of the casting vessel.

18. The apparatus of claim 17 in which the respective outer and inner electromagnetic levitation and containment field producing means each includes a plurality of electromagnetic coils for connection to successive phases of a separately controllable polyphase electric current source for producing the respective outer and inner upwardly travelling alternating electromagnetic levitation and containment fields.

19. The apparatus of claim 18, including a reservoir chamber to contain a bath of liquid metal communicating with the lower end of the annular casting vessel, and means associated with the chamber to move the liquid metal upwardly into the casting vessel to a level above the lower end of the electromagnetic levitation and containment field producing means.

20. The apparatus of claim 19 further including means for precooling the solidified hollow tubular metal product as it emerges from the upper portion of the annular casting vessel, means for rolling the product to a desired dimension and means for cooling the rolled product to an ambient temperature.

21. The apparatus of claim 19 further including means for precooling the solidified hollow tubular metal product, and means for cooling the product to an ambient temperature.

* * * * *

UNITED STATES PATENT AND TRADEMARK OFFICE

CERTIFICATE OF CORRECTION

PATENT NO. : 4,865,116

DATED : Sep. 12, 1989

INVENTOR(S) : Jeffrey N. Peterson and Robert T. Frost

It is certified that error appears in the above-identified patent and that said Letters Patent is hereby corrected as shown below:

On the title page, item [73], delete "General Electric Company, New York, N.Y." and insert --Showa Electric Wire & Cable Co., Ltd., Japan--.

Signed and Sealed this

Nineteenth Day of May, 1992

*Attest:*

DOUGLAS B. COMER

*Attesting Officer*

*Acting Commissioner of Patents and Trademarks*